United States Patent [19]

Long

[11] Patent Number: 4,643,261

[45] Date of Patent: Feb. 17, 1987

[54] MOTOR GRADER WITH SUPPLEMENTARY SURFACE TREATMENT ATTACHMENT

[76] Inventor: George E. Long, 118211 219th Ave., SE., Monroe, Wash. 98272

[21] Appl. No.: 639,726

[22] Filed: Aug. 13, 1984

Related U.S. Application Data

[63] Continuation-in-part of Ser. No. 488,084, Apr. 25, 1983, abandoned.

[51] Int. Cl.[4] ..... A01B 63/118; E02F 3/85

[52] U.S. Cl. ..... 172/2; 15/82; 172/784

[58] Field of Search ..... 172/2, 247, 438, 784, 172/785, 794; 15/82, 83, 84, 85, 86; 56/14.7; 37/232, 241

[56] References Cited

U.S. PATENT DOCUMENTS

| | | | |
|---|---|---|---|
| 524,709 | 8/1894 | Fisher | 15/82 |
| 1,559,278 | 10/1925 | Neuert | 15/78 |
| 1,806,054 | 5/1931 | Gardner | 172/781 |
| 2,188,435 | 1/1940 | Hargrave | 172/784 |
| 2,732,573 | 1/1956 | Hyland | 15/82 |
| 2,978,720 | 4/1961 | Lull | 15/82 |
| 3,022,060 | 2/1962 | Cook et al. | 172/794 X |
| 3,071,793 | 1/1963 | Lull | 15/82 |
| 3,230,645 | 1/1966 | Lutz | 15/82 X |
| 3,287,834 | 11/1966 | Hopkins | 15/82 X |
| 3,448,816 | 6/1969 | Beals et al. | 172/793 |
| 3,735,818 | 5/1973 | Swisher, Jr. et al. | 172/785 |
| 3,880,243 | 4/1975 | Gurries et al. | 172/784 |
| 4,138,756 | 2/1979 | Krier et al. | 15/83 |
| 4,156,466 | 5/1979 | Caldwell | 172/794 X |
| 4,250,696 | 2/1981 | Hash | 56/14.7 |
| 4,290,488 | 9/1981 | Pelsey | 172/123 |
| 4,290,820 | 9/1981 | Swisher, Jr. et al. | 15/83 X |

FOREIGN PATENT DOCUMENTS

| | | | |
|---|---|---|---|
| 411569 | 4/1943 | Canada . | |
| 549156 | 11/1957 | Canada . | |
| 583941 | 9/1959 | Canada . | |
| 662045 | 4/1963 | Canada . | |
| 744906 | 10/1966 | Canada . | |
| 2455200 | 5/1976 | Fed. Rep. of Germany | 15/82 |
| 2821627 | 11/1979 | Fed. Rep. of Germany | 15/82 |
| 1172630 | 12/1969 | United Kingdom | 15/82 |

*Primary Examiner*—Richard T. Stouffer

*Attorney, Agent, or Firm*—Dowrey & Cross

[57] ABSTRACT

A rotary broom attachment for a motor grader, which has a mold board and structure to adjust the mold board for vertical elevation, side shift and rotary position about vertical and horizontal axes, is mounted behind and parallel to the mold board and has independent adjustment and control structure for positioning, and side shifting, if desired, of the broom relative to the mold board. Sensors are used to signal automatic shifting of the broom vertically or in side shift to avoid interference with the motor grader structure as well as obstacles in the path of the broom. The downward pressure of the broom is controlled by the proportional lift applied thereto by a hydraulic lift mechanism.

18 Claims, 16 Drawing Figures

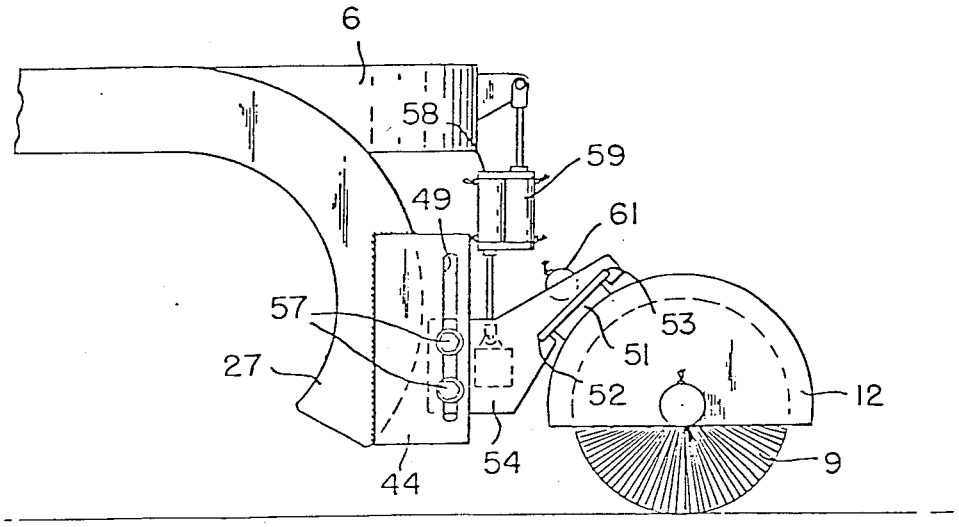
FIG. 9
FIG. 10
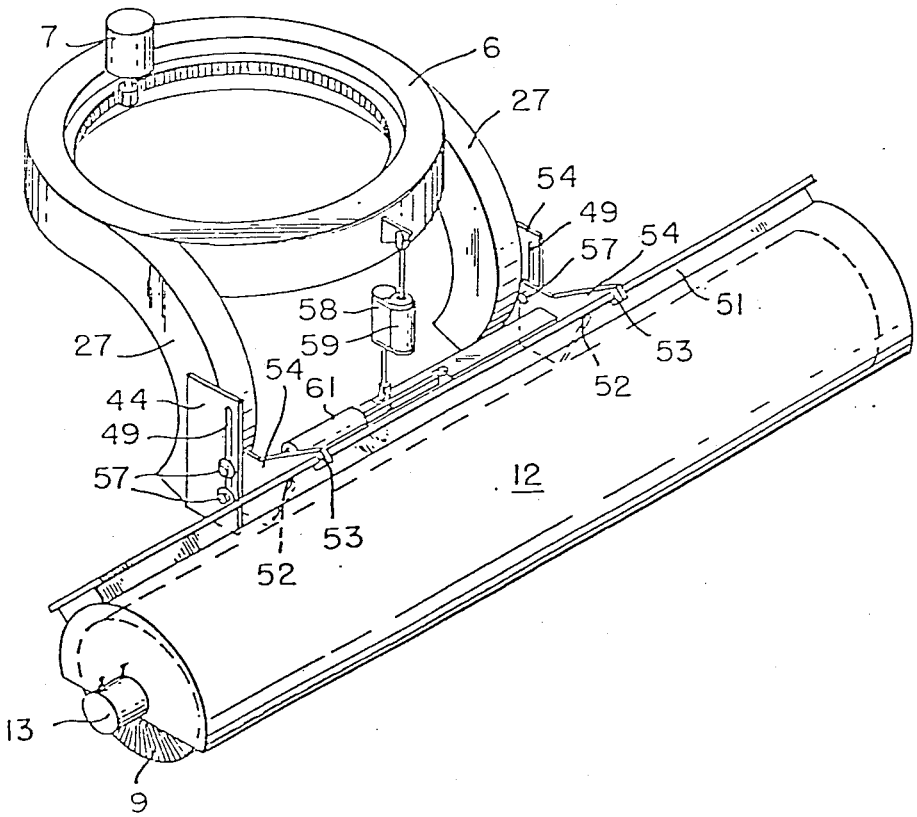

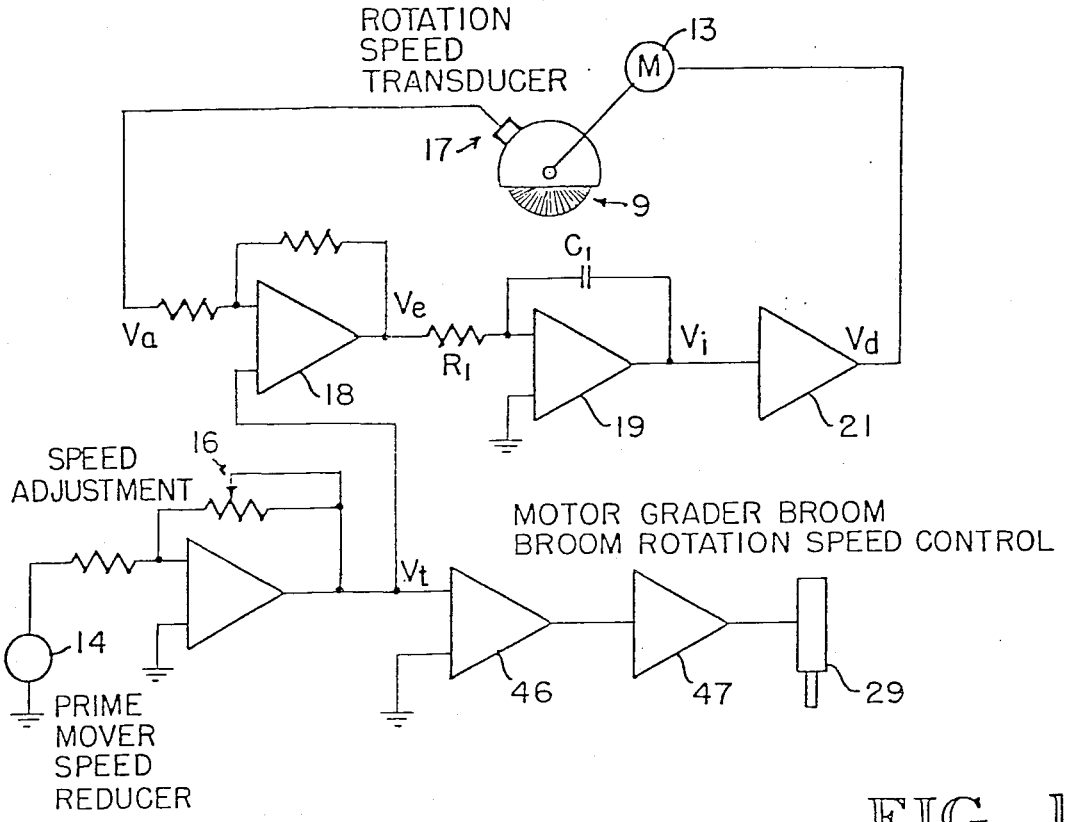
FIG. 11
FIG. 12
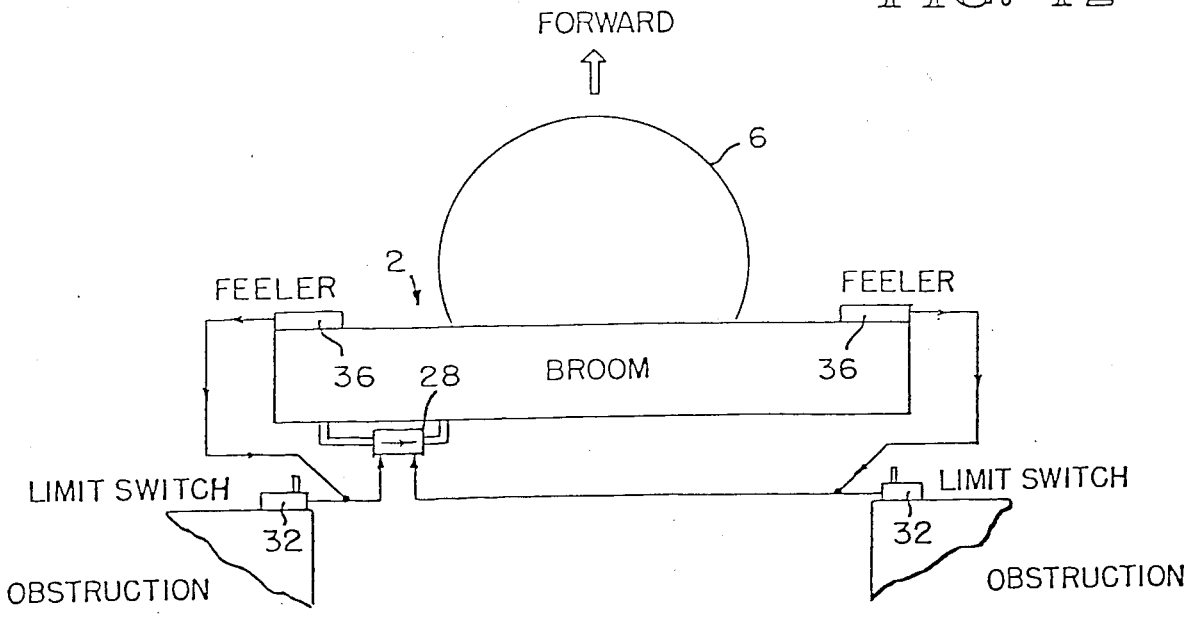

MOTOR GRADER WITH SUPPLEMENTARY SURFACE TREATMENT ATTACHMENT

FIELD OF THE INVENTION

This application is a continuation-in-part of copending application Ser. No. 488,084, filed Apr. 25, 1983, now abandoned. This invention relates to road grading and maintenance equipment, and more specifically to road graders having mold boards or blades for grading a surface, and vehicles having rotary sweepers for brushing debris from a surface.

BACKGROUND OF THE INVENTION

Motor graders having a mold board or blade for scraping a surface are commonly known and extensively used in highway and airport construction and maintenance. In many road construction projects, the grader blade is passed over a surface with the mold board smoothing and scraping off irregularities to provide a finished surface which may then be either paved or coated with oil or asphaltic material to provide a smooth hard surface. A separate piece of equipment requiring its own operator and having a rotary boom mounted thereon is then passed over the finished surface to clear away the finer debris left behind once the construction is completed. In other situations, shoulder repair work may be required on existing paved surfaces. In these situations, a motor grader blade is used to provide a reworked shoulder surface. This procedure may also require other earth moving equipment in the area, creating a need for general clean up of the road surface with a rotary boom for safety reasons as well as appearance. Thus, specialized pieces of equipment and skilled operators are needed in most instances, which contribute significantly to the overall cost. Most road and highway maintenance organizations do in fact need both a grader and a broom.

At present, there is no single apparatus which satisfactorily combines the functions of the motor grader and the rotary broom in such a way that the mold board or the broom can be used separately or together as desired, without time consuming and complicated broom removal or mounting procedures. The need exists, therefor, for a combined grader and broom in which the mold board and the broom may be independently vertically adjustable so that each may be used alternately or together without interference from the other. Preferably, such a device should not be significantly more complicated to operate than a grader alone or a broom alone, and would include automatic side shifting of the broom independently or concurrently with the blade, as well as vertical adjustment of the broom, to avoid its interference with the structure of the motor grader in any position of operation. A prescribed constant downward pressure exerted by the broom, as well as its speed and direction of rotation, should also be automatically controlled.

BRIEF DESCRIPTION OF THE INVENTION

The present invention includes a rotary broom assembly mounted in conjunction with a mold board on a conventional circle arrangement commonly used in motor graders. The broom assembly may be mounted parallel to the mold board on the circle of the grader for movement therewith. Additionally, the broom assembly is capable of vertical adjustment independently of the mold board, and may also be capable of independent sideways movement or "side shifting". For independent vertical adjustment, the broom assembly in one of the illustrated embodiments includes a longitudinal crossbar which passes through a pair of collars on the blade mounting arms which descend from the circle and act as a pivotal axis for vertical pivoting of the broom assembly. In this embodiment a hydraulic ram may be affixed at one end to the circle, and at the other end to any such means as a slide bar or the like mounted on the shield or hood which overlies the broom. The broom assembly thus may be raised and lowered by action of the conventional vertical adjustment of the circle, or may be raised and lowered relative to the circle by a hydraulic ram.

In both a second and third embodiment, vertical adjustment of the broom assembly is accomplished by linear movement. In the second embodiment, pin and slot connector members are mounted directly to the blade mounting arms. The pin and slot connectors carry the broom assembly and may be raised and lowered relative to the blade by means of a double hydraulic ram arrangement acting between the circle and the connectors. In some cases it may be desirable or necessary to use multiple sets of lift cylinders to accomodate or share the load of the broom as it is shifted laterally. In the third embodiment, the broom assembly is carried by pivot arms connected at one end to mounts affixed to the blade mounting arms and on the other to brackets mounted on the broom assembly. One or more hydraulic rams are mounted between the circle and the broom assembly, and shock absorbers are mounted between the blade mounting arms and pivot arms for smooth operation.

For independent side shifting, a horizontal ram may be mounted to act between one of the blade mounting arms and the broom shield in the first embodiment described to shift the broom assembly sideways relative to the mold board and or circle. In the second embodiment the side shift ram may be connected to act between one of the pin and slot connectors and the broom hood.

Feelers or sensor arms positioned on the ends of the broom assembly are used to close switches upon contact with obstacles, causing the horizontal hydraulic ram to automatically side shift the broom away from the obstacle. Limit switches mounted on the structure of the motor grader may be used as sensors which close when contacted by the broom assembly, causing the vertical or horizontal ram to automatically pivot or shift the broom away from the motor grader structure so as to avoid interference between the two when the blade is angled, raised or lowered. Likewise, of course, position sensors mounted in conjunction with the vertical and side shift linkages of the circle may be used to signal the movement of the broom assembly to avoid interference with the motor grader structures.

The number of rotations of the broom per foot of travel of the device is held constant or settable at different preselected speeds by a broom rotation speed control circuit, and the downward pressure of the broom is controlled by a broom pressure control circuit.

Thus a combined grader and broom is provided which has the convenience of automatic position adjustment found in conventional graders, with the additional utility of independently operational grader and broom assemblies.

BRIEF DESCRIPTION OF THE DRAWINGS

FIG. 9 is a side elevational view of a first modification of the broom assembly mounting structure;

FIG. 10 is a perspective view of the first modified mounting structure of FIG. 9;

FIG. 11 is a functional block diagram of the broom rotation speed control circuit;

FIG. 12 is a schematic diagram of the automatic broom side shifting mechanism;

As illustrated in FIG. 3, the circle is rotated by a drive pinion 7, so as to rotate the molde board 4 and, in the present embodiment, the broom assembly 2 in a horizontal plane. The cross angle of the blade or mold board is thus adjusted relative to the direction of travel of the machine to control the width of cut and the windrow the material scraped. The mold board support assembly 8 also provides sideways adjustment of the position of the mold board 4 in response to well known automatic control means, and the side shift cylinder 5. Conventional operator-actuated controls are provided to pivot the circle 6 along a horizontal axis transverse to the length of the mold board 4, as shown in FIG. 7, and also to raise and lower the circle as shown in FIG. 8. It will be understood that the structural details of the described controls for the blade 4 are conventional and form no part of the present invention except as they relate functionally with the rotary broom assembly.

The broom assembly 2 includes a horizontal rotary broom 9 mounted on a rotary shaft 11. A curved shield or hood 12 overlies the broom 9 and prevents debris from flying into the surrounding mechanism in a conventional manner. Referring to FIGS. 3 and 11, the broom assembly 2 may be driven by a conventional reversible hydraulic motor 13 at a speed which is preferably held to a constant number of rotations per foot of forward travel or preselected speeds of the motor grader 1 by a speed adjustment circuit. This circuit includes a speed transducer 14 which produces an output voltage proportional to the speed at which the motor grader is traveling. The output from the speed transducer 14 is connected to a speed adjustment potentiometer 16, which the operator can set to a resistance proportional to the desired number of broom rotations per foot of travel, to produce a resultant voltage Vt proportional to the desired target rotational speed of the broom 9, while a rotational speed transducer 17 produces a voltage Va proportional to the actual rotational speed of the broom 9.

Figure 1:
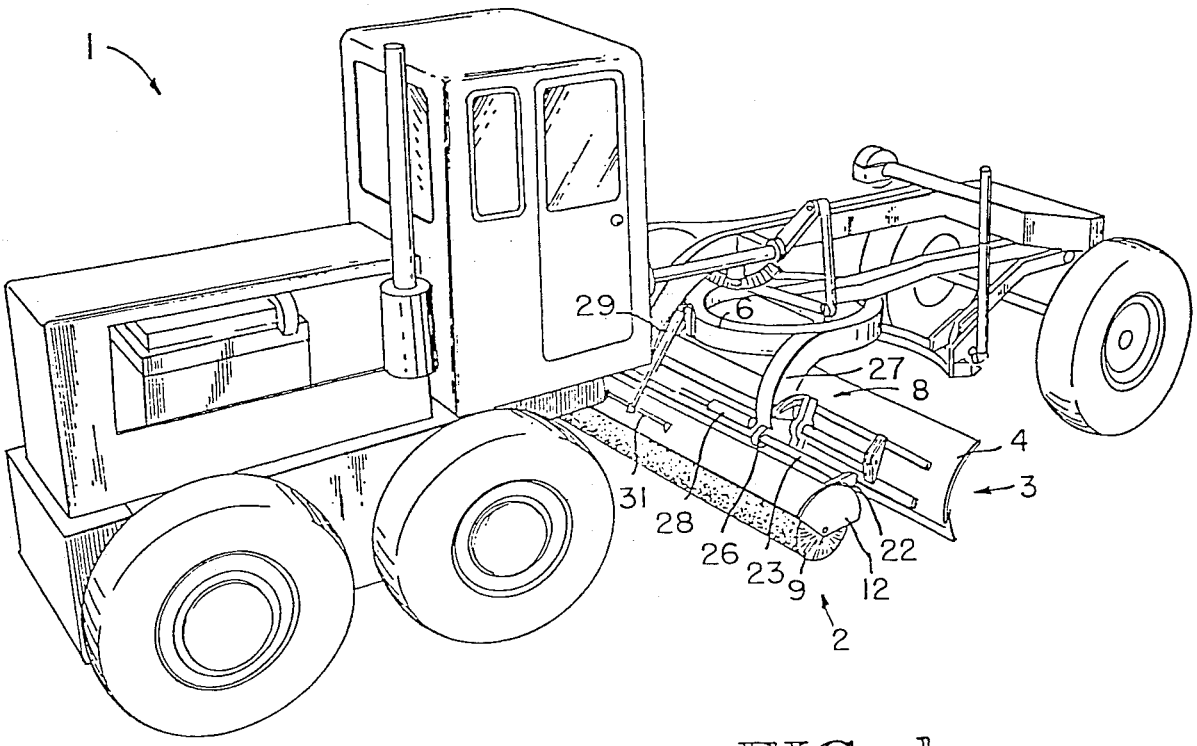
FIG. 1 is a perspective view of a preferred embodiment of the invention.

An error amplifier 18 amplifies the difference between the voltages Va and Vt, and an error integrator 19 integrates the output from the amplifier 18. When the difference between Va and Vt is zero, no correction to the rotational speed of the broom 9 is needed, and the output voltage Vi from the integrator 19 remains constant. If the difference between Va and Vt increases to a non-zero value, then Vi changes at a rate determined by the resistor $R_1$, and capacitor $C_1$, in the integrator 19, to supply the desired voltage to the motor 13. A buffer 21 boosts the voltage Vi as needed to drive the motor 13.

Figure 2:
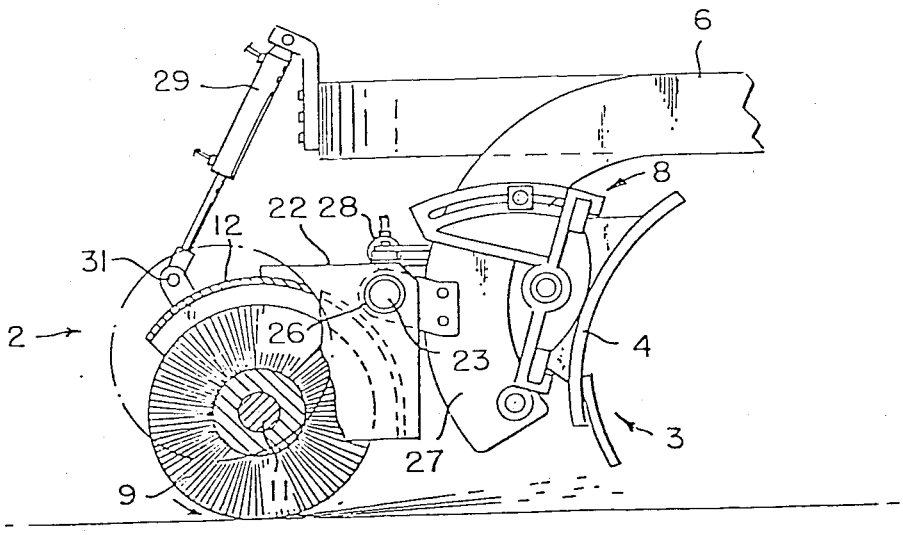
FIG. 2 is a side elevational view of the grader and broom assemblies of the embodiment of FIG. 1 with certain parts broken away.
Figure 3:
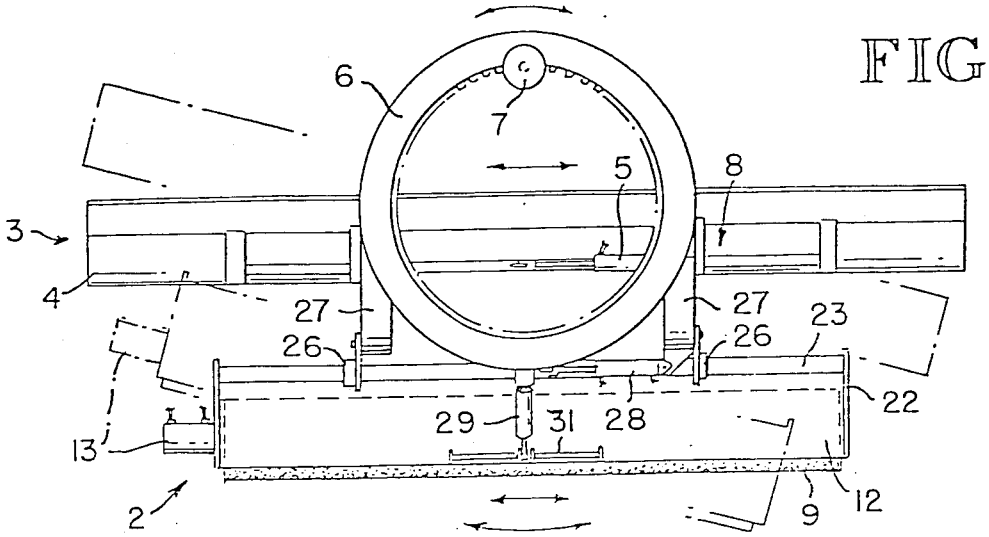
FIG. 3 is a top plan view of the grader and broom assemblies of the embodiment of FIG. 1.

Referring again to FIGS. 1–3, brackets 22 on the opposite ends of shield 12 support a crossbar 23 parallel to the broom 9. The crossbar 23 passes through collars 26 mounted the pair of blade mounting arms 27 which normally extend from and are fixed to the circle 6. The cross bar is slidable received in the collars for linear movement. A horizontally disposed hydrualically actuated ram 28 of conventional design has one end fixed to one of the arms 27, and the other to the shield 12 for shifting the broom assembly 2 sideways. A generally vertical ram 29 is mounted with one end fixed to the circle 6 and the other end slideably mounted on a slide bar 31 on the shield 12 to pivot the broom assembly 2 about the crossbar 23 in a generally vertical position. The slide bar 31 allows the piston allows the piston rod to travel therealong during side shifting of the broom.

Figure 5:
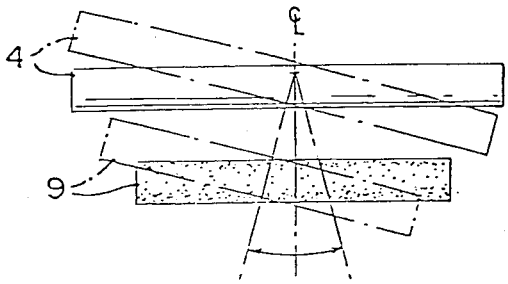
FIGS. 5 and 6 are schematic top plan views showing angular positions of adjustment of the grader and broom assemblies in a horizontal plane.
Figure 6:
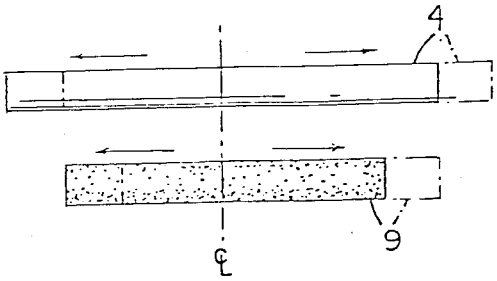
Figure 7:
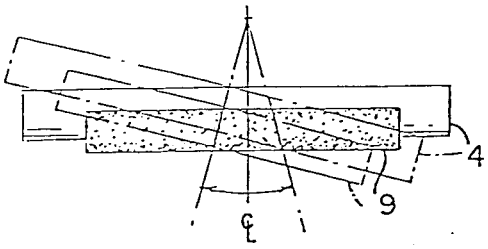
FIGS. 7 and 8 are schematic rear elevation views showing angular positions of adjustment of the grader and broom assemblies in a vertical plane.
Figure 8:
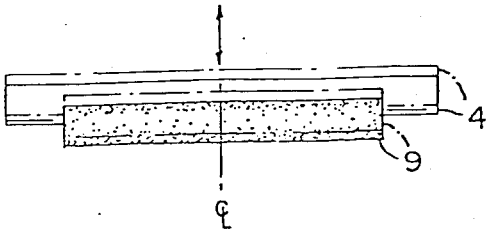
Figure 13:
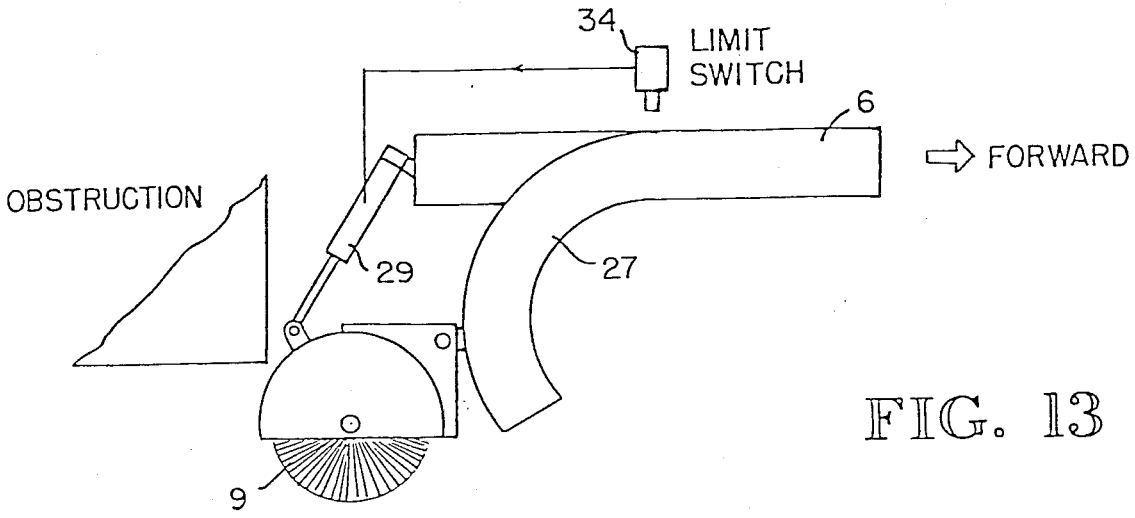
FIG. 13 is a schematic diagram of the automatic broom lowering mechanism.

Referring now to FIGS. 12 and 13, the horizontal and vertical rams 28, 29 in the present embodiment are automatically controlled by three limit switches 32, 33, 34 on the body of the device 1 which close on contact with the broom asembly 2. Each of the first two limit switches 32, 33 is positioned to contact an end of the broom assembly 2 as it rotates or pivots with the circle 6 in the manner shown in FIGS. 5 and 7. It will be understood that the position of the limit switches may be chosen so as to provide the optimum functionality for any particular road grader frame design and degree of movement of the broom desired. On contact, either of these limit switches 32, 33 activates the horizontal ram 28 to shift the broom assembly 2 to the opposite side so that it will not contact either the wheels or frame of the device 1 or other surrounding structure. It will be understood also by those skilled in the art that other rotational controls may be devised such as a limit switch or the like mounted on the circle or any relatively moving parts of the rotary frame. Any such modification is considered to be within the scope of the present invention.

The third limit switch 34 may preferably be positioned on the undercarriage of the device 1 to contact the circle 6 when it is raised beyond a predetermined point where the broom assembly 2 might hit the surrounding structure of the motor grader device at any given position of horizontal rotation. When this contact occurs, the third limit switch 34 will activate the vertical ram 2 to pivot the broom assembly 2 downward, if it is not already in a dropped position, so that it will clear the undercarriage of the device 1 as the broom and grader assemblies 2, 3 are raised along with the circle 6.

To avoid damage to the broom assembly 2 from obstacles on the sides of its path, a feeler 36 as shown in FIG. 12 may be mounted to each end of the broom assembly 2. Each of the two feelers 36 will close a switch on contact with an obstacle in a well known manner, to activate the horizontal ram 28 for shifting the broom assembly 2 away from the obstacle.

Figure 4:
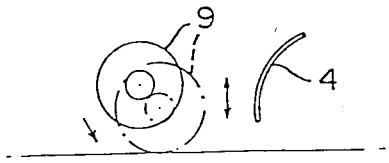
FIG. 4 is a schematic diagram showing vertical adjustment of the broom assembly relative to the grader assembly.
Figure 14:
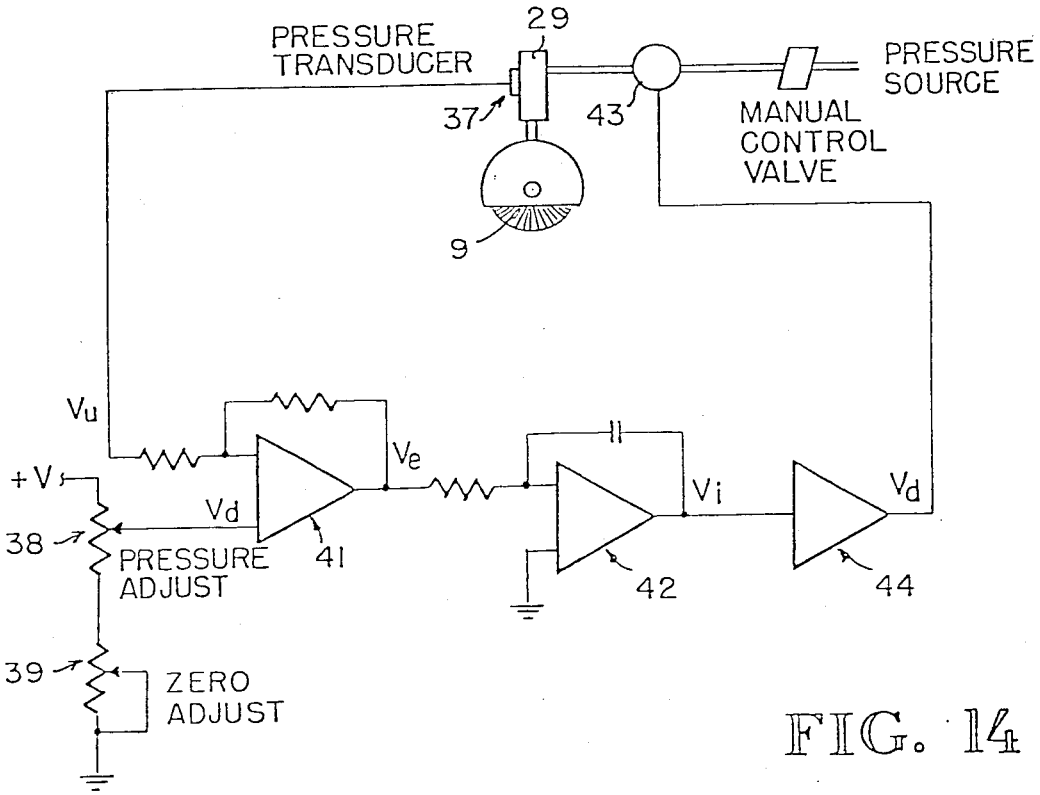
FIG. 14 is a functional block diagram of the broom pressure control circuit.

Referring now to FIGS. 4 and 14, when a sweeping operation is desired, the mold board 4 is raised by the conventional control means of the grader to an elevation several inches above the surface to be swept. In most cases a clearance of 6 to 8 inches above the surface will be sufficient to allow the material being swept by rotary action of the broom to be thrown forwardly under the blade edge. In many cases it is preferred, however, to blade and sweep simultaneously so that the broom is always sweeping the minimum quantity of material thereby extending the broom life. With the broom and blade in the angled position shown in FIG. 5 for instance, the material will work its ways to one side off of the the roadway or to be windrowed and picked up later. The blade positioned in front of the broom will, of course, remove any large obstacles from the path of the broom and prevent any large build up of material as the machine advances. When dirt is windrowed, the broom assembly may be raised and the blade then used in its normal fashion to remove and distribute the material. The broom 9 is positioned to contact the ground by any well-known manual, electrical or other valve means controlled by the machine operator for activating the vertical lift ram 29. The downward pressure of the broom 9 is held constant by an electrical pressure control circuit which maintains a predetermined pressure in the hydraulic cylinder or lines. In this manner only a predetermined proportion of the broom weight is allowed to rest on the surface. This is determined, of course, by the amount of lift pressure maintained in the hydraulic line. As shown is FIG. 14, the control circuit includes a pressure transducer 37 which produces a voltage Vu proportional to the upward force of the vertical ram 29. A pressure adjustment potentiometer 38 and zero adjustment potentiometer 39, which are initially adjusted by the operator, produce a voltage Vd, proportional to the desired pressure of the broom 9. In a manner similar to that of the rotation speed control circuit, an error amplifier 41 amplifies the difference between Vu and Vd, and an error integrator 42 integrates this difference to produce an integrator output voltage Vi, which drives an electric valve 43 through a buffer 44, to supply the amount of hydraulic pressure, to the vertical ram 29 necessary to apply the predetermined amount of lift on the broom 9 to allow it to bear against the road surface with the desired amount of downward pressure.

Referring to FIG. 11, it is preferable that the downward pressure of the broom 9 is ceased, and the broom 9 lifted from the road surface when the motor grader travels in reverse. To accomplish this, a reverse speed comparator 46 receives the voltage Vt representing the rate of travel of the device 1, and activates the vertical ram 29 when the polarity of Vt is reversed from its normal state. A buffer 47 raises the output voltage from the comparator 46 as needed to drive the vertical ram 29.

It will be understood, of course, that in addition to the automatic control of the position of the broom assembly 2 just described, operator-actuated controls are provided to selectively lift or lower the broom assembly 2 relative to the mold board 4 which is equipped with independent lift controls. Thus the broom and mold board may be lifted and lowered independently or in unison, as desired.

FIGS. 9 and 10 illustrate a first modified mounting structure for the broom assembly which provides for linear vertical adjustment of the broom assembly relative to the blade, rather than the pivotal vertical adjustment of the FIGS. 1–4 embodiment. It will be understood, of course, that the overall function of the broom assembly and automatic controls remain the same for both embodiments, the primary difference being in the positioning and functioning of the "side shift" and "vertical lift" rams of the broom assembly. For this reason, identical reference numerals will be used to describe the various structural members of FIGS. 9 and 10 which are identical to the FIGS. 1–4 embodiment.

As seen in FIGS. 9 and 10, the blade support arms 27 which are fixed to the circle 6 are each provided with brackets 48. The brackets 48 may be welded or otherwise fixed to the lower portions of the arms 27, or other suitable locations, and in the embodiment illustrated, are preferably located on the outside surfaces of the arms. Each bracket 48 is provided with an elongated substantially vertical slot 49 which is transversely aligned on the blade arms 27. The transversely extending broom hood 12 is provided with an elongated rail or slider bar structure 51 which is located on one side of the hood 12 adjacent to the brackets 48 and includes the side flanges 52 and 53. The slider bar structure 51 may be made from bar stock and conveniently welded or otherwise fixed to the hood 12. A connector frame serves to connect the broom assembly 2 to the brackets 48, and includes end plates 54, which may be identical and are rigidly connected together by a cross tie bar 56 to form the connector frame. Each end plate is provided with two vertically aligned pins 57 which engage the respective slots 49 in the brackets 48 to from a pin and slot connection to guide vertical lift movement of the connector frame and broom assembly 2. The vertical lfit ram means in this embodiment is connected between the circle 6 and cross tie bar 56 described. In order to gain travel the lift ram means may be comprised of two independent double acting hydraulic cylinder 58 and 59 coupled in a manner illustrated in FIG. 9 so as to substantially double the reach capacity of a single ram. When fixed together in this manner, they may be made to operate sequentially so as to provide both a rough and fine adjustment as will be apparent to those skilled in the art. As previously mentioned, laterally spaced multiple lift rams may be desirable in some instances, to ensure stability as the weight of the broom assembly shifts laterally during "side shifting".

For side shift adjustment, a single horizontal ram 61 is connected between one of the end plates 54 and a suitable connector on the hood 12 as illustrated in FIG. 10. The advantage of the FIGS. 9–10 mounting will lie in its use in those situations when space constraints require a more compact structure and operator.

Figure 15:
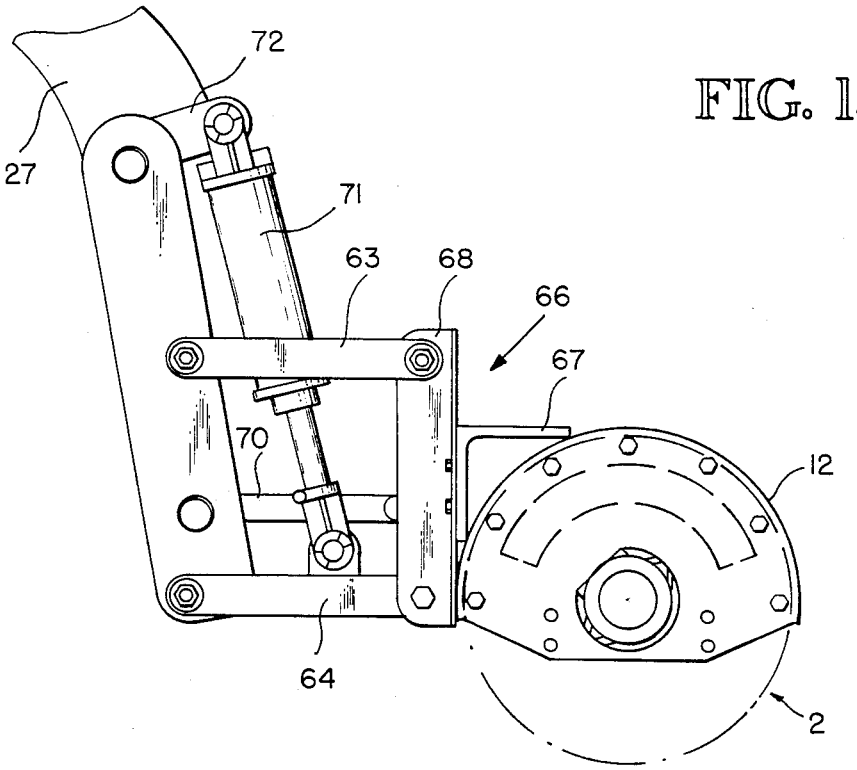
FIG. 15 is a side elevational view of a second modification of the broom assembly mounting structure.
Figure 16:
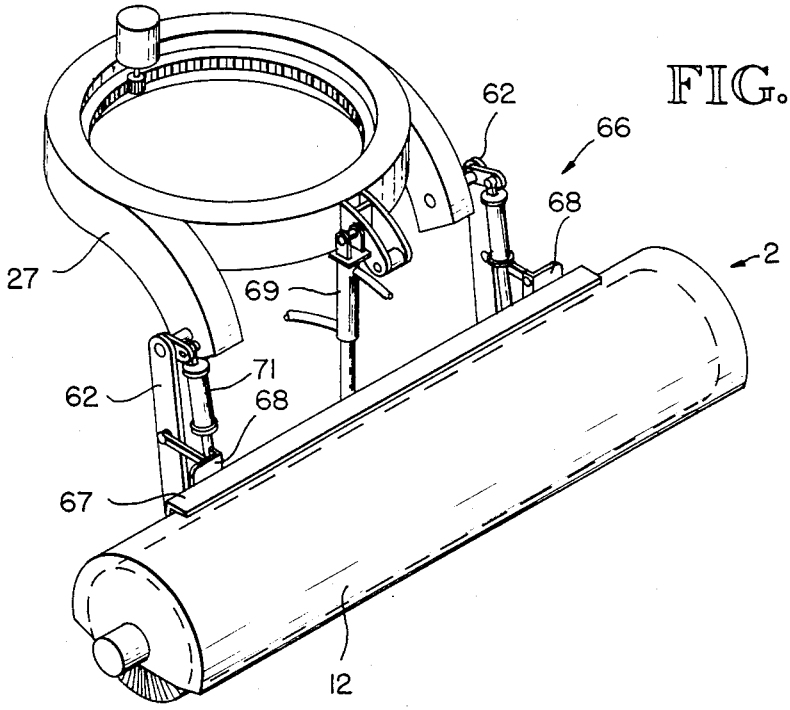
FIG. 16 is a perspective view of the second modified mounting structure of FIG. 15. CDETAILED DESCRIPTION OF A PREFERRED EMBODIMENT Referring to FIGS. 1–3, the motor grader 1 of a preferred embodiment may be conventional in all respects, the operation and control of which are well known in the construction arts. According to the present invention, the device includes a rotary broom assembly 2 mounted parallel to the conventional grader assembly 3 on a circle 6 of a well-known design, for movement therewith. The grader assembly 3 includes a mold board 4 mounted in front of the broom assembly 2, in a conventional manner on the circle 6.

FIGS. 15–16 illustrate a second modified mounting structure for the broom assembly 2, which provides for linear, rather then pivotal, vertical adjustment of the broom assembly 2 relative to the mold board 4. As was the case for FIGS. 9–10 embodiment, it will be understood that the overall function of the broom assembly and automatic controls remain essentially unchanged. Identical reference numerals will be used to describe structural elements in FIGS. 15 and 16 which are identical to those of previously described embodiments.

As seen in FIGS. 15 and 16, the blade support arms 27, shown partially broken away, are each provided, preferably on their outer sides, with mounts 62. which are bolted, or otherwise attached thereto. A pair of generally parallel pivot arms 63 and 64 are pivotally attached to each mount 62 at one end, and to a broom mounting assembly 66 at the other end. This broom mounting assembly 66 includes a bracket 68 on each end of the broom assembly 2. Each bracket 68 is maintained in a vertical position by the pivot arms 63 and 64, which are pivotally attached to opposite sides of the bracket 68 for stability. Each bracket 68 is bolted to an angle bar 67 which is welded to the hood 12. The brackets 68 may be provided with a plurality of vertically spaced holes to provide for selective vertical placement of the broom assembly 2. Likewise the angle bar 67 may be provided with a plurality of laterally spaced holes to provide for selective lateral placement of the broom assembly. Besides providing a location at which the brackets 68 can be bolted to the broom assembly 2, the angle bar 67 also provides structural stability for the hood 12.

Appropriate stabilizing or positioning means such as tie rods, not shown, can be provided to stabilize the lower ends of the mounts 62 against sideways force, and to maintain the alignment necessary to enable the pivot arm linkage to function in a proper manner, permitting the broom assembly to be raised and lowered vertically. If desired, an anti-torsion bar 70 shown in FIG. 15, in the form of a horizontal bar mounted diagonally between the midpoint of a mount 62 on one end of the broom assembly 2, and the midpoint of the bracket 68 on the other end, can be provided.

As seen in FIG. 16, a vertical hydraulic lift ram 69 is mounted between the circle 6 and hood 12. Although a single ram is shown in the figures, two independent double acting hydraulic rams, as in the previously described embodiment, may be used if desired. A shock absorber 71 is mounted at each end of the broom assembly 2, with one end pivotally linked to the mount 62 by an arm 72, and the other end pivotally mounted to the lower pivot arm 64. The shock absorbers 71 ensure the smooth travel and stability of the broom assembly 2. If desired, a pair of hydraulic rams can be mounted in the place of the shock absorbers 71, and the centrally positioned hydraulic ram 69 can be either omitted, or replaced by a shock absorber mounted between the circle 6 and broom assembly 2.

Although the invention has been described with respect to specific preferred embodiments, further modifications to these embodiments are considered to be within the scope of the invention.

What is claimed is:

1. In combination with a motor grader having an adjustably mounted mold board and adjustment control means therefore, a supplementary surface treatment attachment comprising:

a supplementary surface treatment member for contacting the surface traversed by said motor grader, mounting means for mounting said surface treatment member on said motor grader for movement in conjunction with said mold board and for adjusting the position of said surface treatment member relative thereto, position control means for selectively controlling the adjustment of said surface treatment member relative to said mold board, and sensing means operatively associated with said position control means for adjusting the surface treatment member to avoid interfering contact between said surface treatment member and the structure of the motor grader, whereby said mold board and said surface treatment member may be positioned to operate simultaneously or independently without interruption of the operation of the motor grader.

2. The combination according to claim 1 wherein said supplementary surface treatment member comprises a surface sweeping means.

3. The combination according to claim 2 wherein said surface sweeping means comprises a power driven rotary broom member, and a means for driving said rotary broom.

4. The combination according to claim 1 wherein said surface treatment member mounting means comprises:

bracket means affixed to said surface treatment member for selective vertical and horizontal adjustment therewith, a plurality of substantially parallel arms, each being pivotally attached at its first end to said bracket means, and pivot arm mounting means affixed to said motor grader for pivotal attachment to the second ends of said pivot arms.

5. The combination according to claim 4 wherein said position control means includes at least one hydraulic ram mounted in a generally vertical direction between said motor grader and said surface treatment member.

6. The combination according to claim 5 further comprising at least one shock absorber mounted in a generally vertical direction between said motor grader and said surface treatment member.

7. In a motor grader having an adjustable mold board mounting means including a rotary frame member and means to rotate said frame member about a substantially vertical axis, said frame member including mold board mounting arms, a mold board attached to said arms and means to control adjustment of said mounting means to position the mold board for vertical elevation and angular adjustment about vertical and horizontal axes, a supplementary surface treatment attachment comprising;

a supplementary surface treatment member for contacting the surface traversed by the motor grader, surface treatment member mounting means carried by said arms with said surface treatment member extending generally parallel to said mold board, said surface treatment member mounting means mounting said surface treatment member for movement in conjunction with said mold board mounting means and for adjustably positioning said surface treatment member relative to the mold board, control means for controlling the position of said surface treatment member relative to said mold board and mold board mounting means, said surface treatment member mounting means further including adjusting means responsive to said control means for moving said surface treatment member vertically relative to said mold board for vertical control independent of the mold board mounting means, said surface treatment member control means including sensor means for sensing the vertical position of said surface treatment member, said adjusting means being responsive to said sensor means to control the vertical adjustment of the surface treatment member to avoid interference with the structure of said motor grader at predetermined positions of vertical adjustment of the mold board mounting means, whereby said mold board and said surface treatment member may be positioned to operate simultaneously or independently without interruption of the operation of the motor grader.

8. The device of claim 7 wherein, said surface treatment member comprises a rotary broom, said adjusting means including fluid pressure lift means and means to control the fluid pressure lift means to support a predetermined proportion only of the weight of said broom during operation thereof, whereby the pressure of the broom on the surface being treated may be controlled to provide a predetermined sweeping pressure.

9. In a motor grader having an adjustable mold board mounting means including a rotary frame member and means to rotate said frame member about a substantially vertical axis, said frame member including mold board mounting arms, a mold board attached to said arms and means to control adjustment of said mounting means to position the mold board for vertical elevation and angular adjustment about vertical and horizontal axes, a supplementary surface treatment attachment comprising;

a supplementary surface treatment member for contacting the surface traversed by the motor grader, a surface treatment member mounting means carried by said arms with said surface treatment member extending generally parallel to said mold board, said surface treatment member mounting means mounting said surface treatment member for movement in conjunction with said mold board mounting means and for adjustably positioning said surface treatment member relative to the mold board, control means for controlling the position of said surface treatment member relative to said mold board and mold board mounting means, said surface treatment member mounting means further including first and second adjusting means responsive to said control means, said first adjusting means adapted to move said surface treatment member vertically relative to said mold board for vertical control independent of the mold board mounting means, said second adjusting means adapted to shift said surface treatment member longitudinally in both directions relative to said mold board for side shift control independent of the mold board mounting means, said surface treatment member control means including first and second sensor means for sensing the vertical position of said surface treatment member and the rotary position thereof about a vertical axis respectively, said first adjusting means being responsive to said first sensor means to control the vertical adjustment of the surface treatment member to avoid interference with the structure of said motor grader at predetermined positions of vertical adjustment of the mold board mounting means, and said second adjusting means being responsive to said second sensor means to control side shift of the surface treatment member to avoid interference with the structure of said motor grader at predetermined positions of rotation, whereby said mold board and said surface treatment member may be positioned to operate simultaneously or independently without interruption of the operation of the motor grader.

10. The device of claim 9 wherein, said surface treatment member control means includes;

third sensor means mounted on said surface treatment member for sensing the presence of obstacles in the path of movement thereof, said second adjusting means being responsive to said third sensor means to control side shift of the surface treatment member to avoid interference with sensed obstacles during movement of the motor grader.

11. The device of claim 10 wherein, said surface treatment member comprises a rotary boom, said surface treatment member mounting means mounting said broom behind said mold board relative to the direction of forward travel of said motor grader.

12. The device of claim 11 including means for rotating said broom and means to control the speed of rotation thereof in a predetermined ratio to the speed of travel of the motor grader.

13. In combination with a motor grader having an adjustably mounted mold board and adjustment control means therefore, a supplementary surface treatment attachment comprising;

a supplementary surface treatment member for contacting the surface traversed by said motor grader, mounting means for mounting said surface treatment member on said motor grader for movement in conjunction with said mold board and for adjusting the position of said surface treatment member relative thereto, position control means for selectively controlling the adjustment of said surface treatment member relative to said mold board, adjusting means responsive to said control means for moving said surface treatment member relative to said mold board, and sensor means for sensing the position of said surface treatment member relative to the motor grader structure, said adjusting means being responsive to said sensor means to control the adjustment of the surface treatment member to avoid interference with the structure of said motor grader, whereby said mold board and said surface treatment member may be positioned to operate simultaneously or independently without interruption of the operation of the motor grader.

14. In a motor grader broom having an adjustable mold board mounting means including a rotary frame member, said frame member including mold board mounting members, a mold board attached to said mounting members, means to control adjustment of said mounting means to position the mold board for vertical elevation and angular rotational adjustment, a supplementary surface treatment attachment comprising;

a supplementary surface treatment member for contacting the surface traversed by the motor grader, surface treatment member mounting means carried by said mold board mounting means with said surface treatment member extending generally parallel to said mold board, said surface treatment member mounting means mounting said surface treatment member for movement in conjunction with said mold board mounting means and for adjustably positioning said surface treatment member relative to the mold board, control means controlling the position of said surface treatment member relative to said mold board and mold board mounting means, said surface treatment member mounting means further including adjusting means responsive to said control means for moving said surface treatment member vertically relative to said mold board for vertical control independent of the mold board mounting means, said surface treatment member control means including sensor means for sensing the position of said surface treatment member relative to the motor grader structure, said adjusting means being responsive to said sensor means to control the vertical adjustment of the surface treatment member to avoid interference with the structure of said motor grader, whereby said mold board and said surface treatment member may be positioned to operate simultaneously or independently without interruption of the operation of the motor grader.

15. In a motor grader having an adjustable mold board mounting means including a rotary frame member and means to rotate said frame member about a substantially vertical axis, said frame member including mold board mounting arms, a mold board attached to said arms and means to control adjustment of said mounting means to position said mold board for vertical elevation and angular adjustment about vertical and horizontal axes, a supplementary surface treatment attachment comprising;

a broom member for contacting the surface traversed by the motor grader, broom member mounting means carried by said arms for mounting said broom member with the longitudinal axis thereof extending generally parallel to said mold board, said broom member mounting means mounting said broom member for movement in conjunction with said mold board mounting means and moving said broom member vertically, relative to said mold board, control means for controlling the vertical position of said broom member relative to said mold board and mold board mounting means independently of the mold board mounting means, sensing means operatively associated with said control means for adjusting said broom member to avoid interfering contact between the broom member and the structure of the motor grader, said broom member mounting means including fluid pressure lift means and said control means including means to selectively control the fluid pressure lift means to support a predetermined porportion only of the weight of said broom member, whereby said mold board and said broom member may be positioned to operate simultaneously or independently without interruption of the operation of the motor grader and the pressure of the broom member on the surface being treated may be controlled to provide a predetermined sweeping pressure.

16. The device of claim 15 wherein said broom member comprises a rotary broom including;

means for rotating said broom member, and means to control the speed of rotation of said broom member in a predetermined ratio to the speed of travel of the motor grader.

17. In combination with a motor grader having an adjustably mounted mold board and adjustment control means therefore, a supplementary surface treatment attachment comprising:

a supplementary surface treatment member for contacting the surface traversed by said motor grader, mounting means for mounting said surface treatment member on said motor grader for movement in conjunction with said mold board for adjusting the position of said surface treatment member relative thereto, position control means for selectively controlling the adjustment of said surface treatment member relative to said mold board, adjusting means responsive to said control means for moving said surface treatment member relative to said mold board, and sensing means operatively associated with said adjusting means for controlling the adjustment of the surface treatment member to avoid interfering contact with the structure of said motor grader, whereby said mold board and said surface treatment member may be positioned to operate simultaneously or independently without interruption of the operation of the motor grader.

18. In a motor grader broom having an adjustable mold board mounting means including a rotary frame member, said frame member including mold board mounting members, a mold board attached to said mounting members, means to control adjustment of said mounting means to position the mold board for vertical elevation and angular rotational adjustment, a supplementary surface treatment attachment comprising;

a supplementary surface treatment member for contacting the surface traversed by the motor grader, surface treatment member mounting means carried by said mold board mounting means with said surface treatment member extending generally parallel to said mold board, said surface treatment member mounting means mounting said surface treatment members for movement in conjunction with said mold board mounting means and for adjustably positioning said surface treatment member relative to the mold board, control means controlling the position of said surface treatment member relative to said mold board and mold board mounting means, said surface treatment member mounting means further including adjusting means responsive to said control means for moving said surface treatment member vertically relative to said mold board for vertical control independent of the mold board mounting means, and sensing means operatively associated with said adjusting means for controlling the adjustment of the surface treatment member to avoid interfering contact with the structure of said motor grader, whereby said mold board and said surface treatment member may be positioned to operate simultaneously or independently without interruption of the operation of the motor grader.

* * * * *